US010759199B2

(12) United States Patent
Mashiach et al.

(10) Patent No.: US 10,759,199 B2
(45) **Date of Patent: *Sep. 1, 2020**

(54) GAP EQUALIZATION FOR PRINTING WITH MULTIPLE PRINT ENGINES

(71) Applicant: HEWLETT-PACKARD DEVELOPMENT COMPANY, L.P., Spring, TX (US)

(72) Inventors: On Mashiach, Ness Ziona (IL); Yoav Landau, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/519,368

(22) Filed: Jul. 23, 2019

(65) Prior Publication Data

US 2019/0344590 A1 Nov. 14, 2019

Related U.S. Application Data

(63) Continuation of application No. 15/491,095, filed on Apr. 19, 2017, now Pat. No. 10,384,476.

(51) Int. Cl.

| | |
|---|---|
| ***B41J 29/38*** | (2006.01) |
| ***B41J 11/00*** | (2006.01) |
| ***B41J 11/46*** | (2006.01) |

(52) U.S. Cl.

CPC ..... *B41J 11/0095* (2013.01); *B41J 11/008* (2013.01); *B41J 11/46* (2013.01)

(58) Field of Classification Search

USPC ..... 347/16, 104

See application file for complete search history.

(56) References Cited

U.S. PATENT DOCUMENTS

| | | | | |
|---|---|---|---|---|
| 6,154,621 | A | 11/2000 | Yamamoto | |
| 6,731,890 | B1 * | 5/2004 | Rakov | G03G 15/1675 399/299 |
| 7,272,334 | B2 | 9/2007 | Moore et al. | |
| 8,169,657 | B2 | 5/2012 | Wang et al. | |
| 8,301,061 | B2 | 10/2012 | Pitas et al. | |
| 8,408,828 | B2 | 4/2013 | Ouchi | |
| 8,935,980 | B2 | 1/2015 | Ruhm et al. | |
| 2008/0150993 | A1 | 6/2008 | Maki | |
| 2010/0294154 | A1 | 11/2010 | Rapkin et al. | |
| 2012/0075395 | A1 * | 3/2012 | Moore | B41J 11/002 347/104 |

OTHER PUBLICATIONS

Rick, L. et al.; "Is Image-on-Image Color Printing a Privileged Printing Architecture for Production Digital Printing Applications?"; 2004.
(cont. from above) <http://wvvw.ingentaconnect.com/content/ist/nipdf/2004/00002004/00000001/art00073.

* cited by examiner

*Primary Examiner* — Lam S Nguyen
(74) *Attorney, Agent, or Firm* — Fabian VanCott

(57) ABSTRACT

In one example in accordance with the present disclosure, a printing system is described. The printing system includes multiple print engines to form printed marks on a substrate. Each print engine prints non-sequential pages of a print job. A sensor of the printing system detects, for each page, a trailing edge gap size and a leading edge gap size. A controller of the printing system, based on a difference between trailing edge gap sizes and leading edge gap sizes for a set of pages of a print job, adjusts a printing operation to equalize subsequent trailing edge gap sizes and leading edge gap sizes.

19 Claims, 5 Drawing Sheets

GAP EQUALIZATION FOR PRINTING WITH MULTIPLE PRINT ENGINES

BACKGROUND

Printing systems work to deposit a printing compound, such as ink or toner, onto a substrate or other surface to form an image, text, or other pattern. In some examples, a printing engine of the printing system operates by forming a printing compound pattern on a photoconductor via electrostatic attraction. The printing compound pattern is then transferred to a transfer roller. As a substrate, such as paper, is pinched between the transfer roller and a pressure roller, the printing compound pattern is transferred to the substrate. In another example, an array of nozzles eject fluid to form the pattern. In these cases, and others, a printing system can include multiple print engines where a first print engine prints a first set of pages of a print job, and a second print engine prints a second set of pages.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
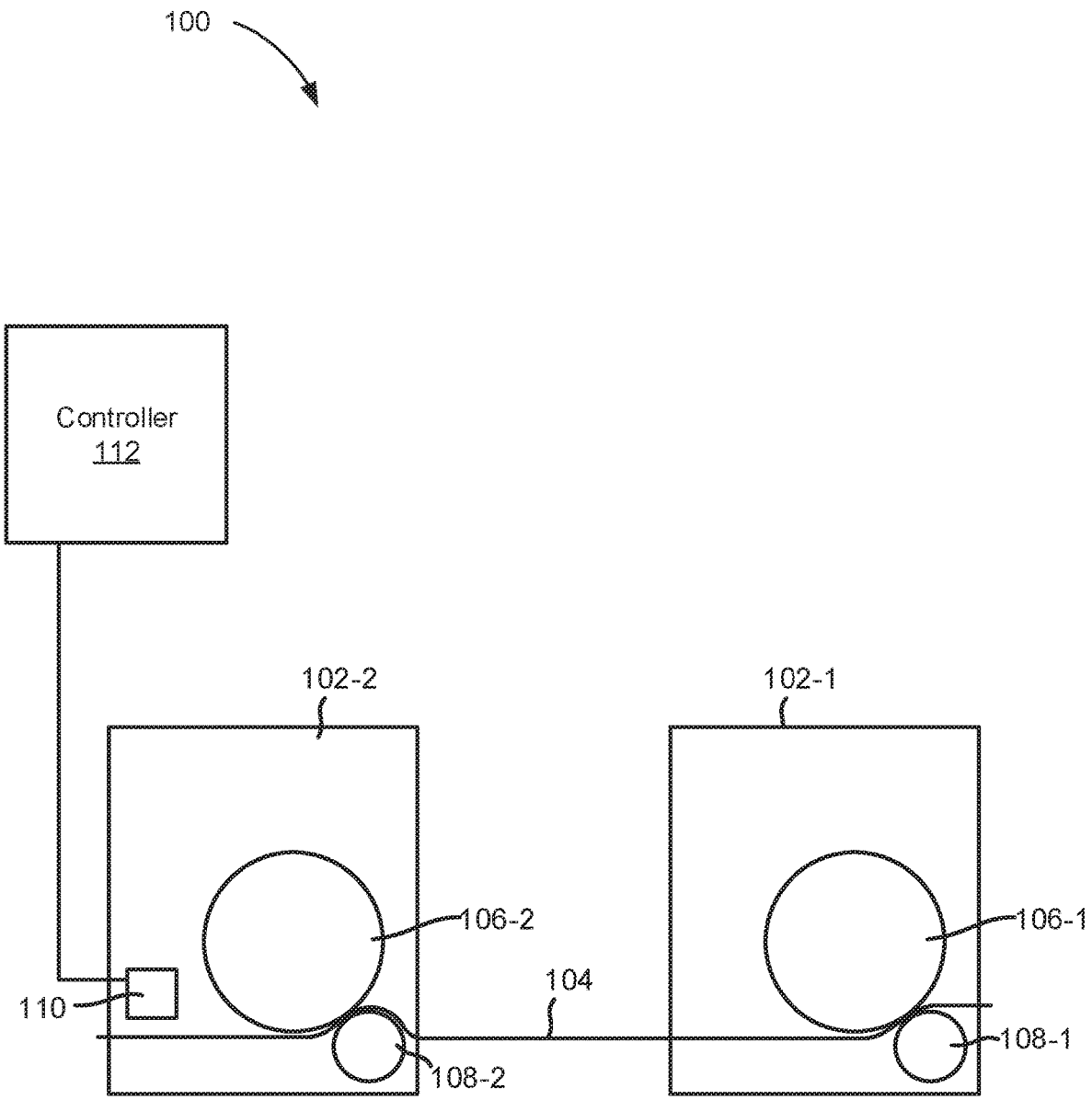
FIG. 1 is a block diagram of a system for gap equalization for non-sequential printing with multiple print engines, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Printing systems work to deposit a printing compound, such as ink or toner, onto a substrate or other surface to form an image, text, or other pattern. In some examples, a printing engine of the printing system operates by forming a printing compound pattern on a photoconductor via electrostatic attraction. The printing compound pattern is then transferred to a transfer roller. As a substrate, such as paper, is pinched between the transfer roller and a pressure roller, the printing compound pattern is transferred to the substrate. In another example, an array of nozzles eject fluid to form the pattern. In these cases, and others, a printing system includes multiple print engines where a first print engine prints a first set of pages of a print job, and a second print engine prints a second set of pages.

In some examples, the multiple print engines print non-sequential pages and do not print pages of a job in order. For example, a first print engine may be upstream of a second print engine. The first print job may print alternating pages of a print job, i.e., page 1, page 3, page 5, leaving a blank space for sequential pages to be printed. After those pages are formed, the substrate passes under the second print engine that prints alternating pages between those already printed, i.e., page 2, page 4, etc. These systems enhance printing efficiency by allowing two print engines to work simultaneously to process a print job. However, a multi-print engine non-sequential system introduces some complications.

For example, image alignment on a substrate is a challenge in any printing operation, and doing so on a multi-print engine system where a second print engine is inserting pages between a pair of first print engine pages exacerbates this challenge.

Accordingly, the present specification describes systems and methods for aligning the second print engine pages between the first print engine pages such that gaps between sequential pages are the same. That is the present specification describes systems and methods that produce consistent gap sizes between sequential pages.

Specifically, the present specification describes a system that 1) measures a trailing edge gap and a leading edge gap for each page in a set of pages. A difference between the trailing edge gap and the leading edge gap is calculated. Based on this difference, an equalized, or target gap size is determined. An operation of the printing device is then changed such that subsequent gaps have the equalized, or target, gap size. For example, the substrate transport can be increased or decreased to ensure equal gap size. In this example, a buffer unit on the printing system may allow substrate speed change for one engine without affecting the other. In another example, the timing of printing compound deposition by the second print engine and/or the first print engine may be adjusted.

The present specification describes a printing system. The printing system includes multiple print engines to form printed marks on a substrate. Each print engine prints non-sequential pages of a print job. A sensor of the printing system detects, for each page, a trailing edge gap size and a leading edge gap size. A controller of the print engine adjusts a printing operation, based on a difference between trailing edge gap sizes and leading edge gap sizes for a set of pages of a print job, to equalize subsequent trailing edge gap sizes and leading edge gap sizes.

The present specification also describes a method for gap equalization in multi-print engine non-sequential printing. According to the method, for a number of pages, a difference between a leading edge gap and a trailing edge gap between the page and corresponding adjacent pages is determined. According to this method, sequential pages are printed by different print engines. An equalized value for subsequent trailing edge gaps and leading edge gaps is then determined from the differences between the leading edge gap and the trailing edge gap or the number of pages. An operation of a printing device is then adjusted such that the subsequent trailing edge gaps and subsequent leading edge gaps match the equalized value.

The present specification also describes a computing system. The computing system includes a processor and a machine-readable storage medium coupled to the processor.

An instruction set stored in the machine-readable storage medium is executed by the processor. The instruction set includes instructions to determine for a number of pages, a difference between a leading edge gap and a trailing edge gap between the page and corresponding adjacent pages, wherein sequential pages are printed by different print engines. The instruction set also includes instructions to determine from the differences between a leading edge gap and a trailing edge gap for the number of pages, an equalized value for subsequent trailing edge gaps and for subsequent leading edge gaps. Still further, the instruction set includes instructions to adjust an operation of a printing device such that the subsequent trailing edge gaps and subsequent leading edge gaps match the equalized value.

In summary, using such a printing system and method 1) enhances second engine page placement; 2) reduces differences between trailing edge gaps and leading edge gaps for a page of a print job; 3) dynamically changes the adjustments over the duration of the print job; 4) provides a closed feedback loop to adjust gap sizes; and 5) enhances overall print quality. However, it is contemplated that the devices disclosed herein may address other matters and deficiencies in a number of technical areas. Therefore, the systems and devices disclosed herein should not be construed as addressing just the particular elements or deficiencies discussed herein.

As used in the present specification and in the appended claims, the term "a number of" or similar language is meant to be understood broadly as any positive number including 1 to infinity.

FIG. 1 is a block diagram of a printing system (100) for gap equalization for non-sequential printing with multiple print engines (102), according to an example of the principles described herein. The printing system (100) includes multiple print engines (102-1, 102-2) to form printed marks on a substrate (104). The substrate (104) may be any media on which printing compound may be disposed and includes a web roll of paper. Within the figures the indication "-*" refers to a specific instance of a component. For example, a first print engine is identified as (102-1). By comparison, the absence of an indication "-*" refers to the component in general. For example, a print engine in general is referred to as a print engine (102).

The print engines (102) can deposit printing compound in any number of fashions. For example, in electro photographic printing a uniform electric charge is applied to a photoconductor drum having a photosensitive out surface. As the photoconductor drum rotates, the surface is selectively exposed by a photo-imaging device to discharge certain portions of the photoconductor in a pattern corresponding to the desired image. Printing fluid or toner is then applied to the photoconductive drum due to electrostatic attraction between the printing compound and the charged surfaces of the photoconductor drum. The printing compound is then transferred to a transfer roller (106). The printing compound is then transferred to a sheets or a web of substrate (104) passing between the transfer roller (106) and a pressure roller (108). For simplicity in the figures, some of these elements have been omitted. While a specific example of a printing system with a photoconductor drum has been described other examples may be implemented in accordance with the principles described herein including belt printing systems.

While one specific type of printing operation has been described, the print system (100) may be any type of print system (100) including an inkjet print system (100) wherein an array of nozzles eject fluid ink in a predetermined pattern to form the images and/or text.

As described, the print system (100) includes multiple print engines (102) each operating as described above. For example, a first print engine (102-1) includes at least a first transfer roller (106-1) and a first pressure roller (108-1) used to apply printing compound to the substrate (104). A second print engine (102-2) includes at least a second transfer roller (106-2) and a second pressure roller (108-2). The different print engines (102) print alternate pages of a print job. That is, the first print engine (102-1) may print odd number pages, i.e., 1, 3, 5, and so on and the second print engine (102) may print even number pages, i.e., 2, 4, 6 and so on. However, the first print engine (102-1) prints its corresponding pages prior to the second print engine (102-2) printing its pages. For example, the first print engine (102-1) prints a first page and a third page, leaving a blank for the second page to be printed. Accordingly, when the substrate reaches the second print engine (102-2), the second print engine (102-2) prints the second page in the blank area between the first page and the third page. Put yet another way, the multiple print engines (102) of the print system (100) print non-sequential pages of a print job.

Doing so is efficient as the multiple print engines (102) can operate simultaneously to process a single print job. However, it does complicate the alignment of adjacent pages. For example, it may be desirable that the pages printed by the second print engine (102-2) are centered in the blank area left by the first print engine (102-1). Whether a page is printed in the center of the blank space can be determined by measuring a gap between the page and the adjacent pages, which have already been printed and comparing differences there between.

Accordingly, the print system (100) includes a sensor (110) to, for each page, detect a trailing edge gap size and a leading edge gap size. As used in the present specification a leading edge gap size refers to a gap between the current page and the preceding page. So, for example, a leading edge gap of the second page would be the distance between the end of page 1 and the beginning of page 2. Accordingly, the trailing edge gap size refers to a gap size between the current page and the subsequent page. So, for example, a trailing edge gap of the second page would be the distance between the end of page 2 and the beginning of page 3.

Due to a number of factors, the trailing edge gap and the leading edge gap may be different. Examples of such factors include the size of the pages printed by the first print engine (102-1), the size of the pages printed by the second print engine (102-2), the insertion point of the pages printed by the first print engine (102-1), and the insertion point of the pages printed by the second print engine (102-2). The sensor (110) measures these gap distances and by so doing provides information to a controller (112) that will allow the system to change the printing operation such that the gap distances are the same. The sensor (110) may be any type of scanner (110), including an optical scanner that reads registration marks on the pages to determine gap distances. That is, in addition to printing images, each print engine (102) may print registration marks, one on a leading edge of the page and one on the trailing edge of the page. The sensor (110) which is disposed after the second print engine (102-2) in the direction of substrate (104) travel measures the distance between adjacent trailing edges and leading edges to determine gap distances. Accordingly, for each page, there may be two gap measurements collected, a leading edge gap size for a page and a trailing edge gap size for a page. Note that the trailing edge gap size for one page may be the leading edge gap size for a subsequent page.

In some examples, this measurement of gap sizes may occur after a predetermined number of pages have been printed. Specifically, during the first few pages, for example, 5-10 pages, the printing system (100) may be warming up and certain operations may render any gap sensing inaccurate. After the few pages have been processed, any gap measurement is more reliable and at this point, the sensor (110) begins taking measurements.

A controller (112) of the printing system (100) receives these gap measurements and uses them to adjust the printing operation. For example, the controller (112) may acquire trailing edge gap sizes for each page and leading edge gap sizes for each page and determine a difference between the two. From the difference, an equalized value can be determined. The equalized value may simply be an average of the trailing edge gap size and the leading edge gap size. The determined difference may be accounted by offsetting both of the leading edge gap and the trailing edge gap.

In some examples, trailing edge and leading edge gap sizes are calculated for a number of sequential pages, for example between 15 and 20. An average for the leading edge gap size and an average for the trailing edge gap size are then calculated and the difference determined by the controller (112) is a difference between the average values.

The controller (112) then adjusts a printing operation to equalize subsequent trailing edge gap sizes and leading edge gap sizes. That is, an operation is performed that results in each of a trailing edge gap and a leading edge gap being the same as the equalized value.

An example of an adjustment of such an operation is the timing of the operations of the print engines (102). As a specific example, the second print engine (102-2) could print earlier or later, which would affect the positioning of the corresponding pages on the substrate. Another example of a printing operation that could be adjusted is the speed of substrate transport.

To this end, the controller (112) may reference a database that includes mappings between the difference between trailing and leading edge gaps and printing operations. That is, once the controller (112) determines the difference between gaps for a particular set of sequential pages, the database may be referenced to learn how the various print operations should be changed, whether that be changing the insertion time of the image, changing the speed of one of the print engines (102), or any other printing operation.

The system (100) as described herein increases the degree to which pages printed by the second print engine (102-2) are disposed centrally within a blank left by the first print engine (102-1). Centrally disposed pages result in a higher quality work product and simpler processing later on.

Figure 2:
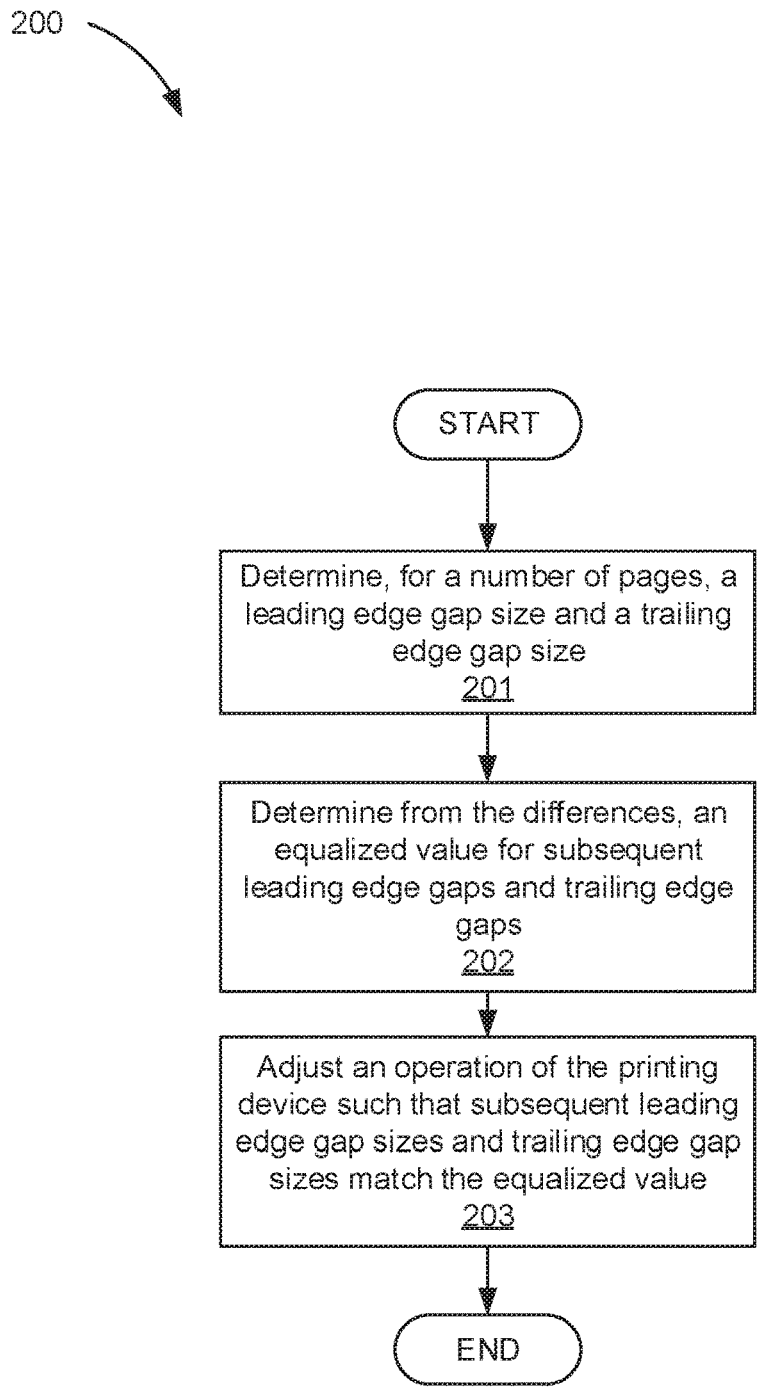
FIG. 2 is a flowchart of a method for gap equalization for non-sequential printing with multiple print engines, according to an example of the principles described herein.

FIG. 2 is a flowchart of a method for gap equalization for non-sequential printing with multiple print engines (FIG. 1, 102), according to an example of the principles described herein. As a general note, the method (200) may be described below as being executed or performed by at least one device, for example, the sensor (FIG. 1, 110) and controller (FIG. 1, 112). Other suitable systems and/or computing devices may be used as well. The method (200) may be implemented in the form of executable instructions stored on at least one machine-readable storage medium of at least one of the devices and executed by at least one processor of at least one of the device. Alternatively, or in addition, the method (200) may be implemented in the form of electronic circuitry (e.g., hardware). While FIG. 2 depicts operations occurring in a particular order, a number of the operations of the method (200) may be executed concurrently or in a different order than shown in FIG. 2. In some examples, the method (200) may include more or less operations than are shown in FIG. 2. In some examples, a number of the operations of the method (200) may, at certain times, be ongoing and/or may repeat.

According to the method (200), a difference between a leading edge gap and a trailing edge for a number of pages is determined (block 201). That is, each page of a print job has a leading edge gap referring to a distance between the leading edge of that page and a trailing edge of an upstream page. Each page also has a trailing edge gap referring to a distance between the trailing edge of that page and a leading edge of a subsequent page. Due to a variety of reasons including page insertion and page size, these gaps may be different. Differences in these gaps indicate a page is not centered between adjacent pages. Not being centered may be aesthetically unpleasing and cause complications elsewhere in substrate processing. For example, following printing the roll of paper may be cut. If the gaps are not equal, then portions of the page that have text/images may be cut as well.

A sensor (FIG. 1, 110) disposed on the second print engine (FIG. 1, 112-2) reads registration marks indicating the trailing edge and leading edge of each page. A controller (FIG. 1, 112) then takes those measurements to determine a gap between a trailing edge of one page and a leading edge of the subsequent page. The controller (FIG. 1, 112) also determines a difference between leading edge gap sizes and trailing edge gap sizes. In some examples, this includes determining a difference between average leading edge gap sizes and average trailing edge gap sizes. That is, during a data collection period, the sensor (FIG. 1, 110) and controller (FIG. 1, 112) may operate to collect data and determine a number of differences between the types of gaps. An average for each type of gap can be calculated and a difference determined between the averaged values. From this difference, an equalized value may be determined (block 202), which equalized value represents the target gap size for subsequent printing.

An operation of an associated printing device is then adjusted (block 203). Specifically, the operation is adjusted such that subsequent trailing edge gaps and subsequent leading edge gaps match the equalized value. Examples of operations that may be adjusted include a speed of the substrate transport system, a speed of operation of the first print engine (102-1) and/or the second print engine (102-2), and/or a timing of printing compound application of the first print engine (102-1) and/or the second print engine (102-2).

In some examples, the method (200) may be iterative. That is, even following an adjustment (block 203) of the printing operation, changes in the printing device may occur that may introduce new offsetting within the pages. Accordingly, following an initial adjustment, the operations of determining for a number of pages, a difference between a leading edge gap and a trailing edge gap, determining from the differences an equalized value, and adjusting an operation may be performed periodically to 1) correct for any overshoot from a first iteration, and 2) to account for new sources of misalignment.

In some examples, adjustment (block 203) of the print operation may account for the entirety of the calculated difference or equalized value. For example, for a first few cycles, such as five, each time a difference is determined between corresponding gaps, the adjustment to the operation works to adjust each subsequent gap to be the equalized value. In other examples, adjustment (block 203) of the print operation may occur in cycles. For example, rather than accounting for the entire difference in one adjustment of an operation, the entire difference may be accounted for by multiple adjustments to the operation.

For example, presume a gap difference of 3 millimeters (mm) exist between the leading edge gap and the trailing edge gap. In a single iteration example, printing operations may be adjusted to account for the entire 3 mm difference in a single operation. By comparison, in another example, printing operations may be adjusted to account for a portion of the 3 mm difference, for example 20%, and this adjustment may be made over sets of pages to ultimately account for the entire 3 mm difference.

Figure 4:
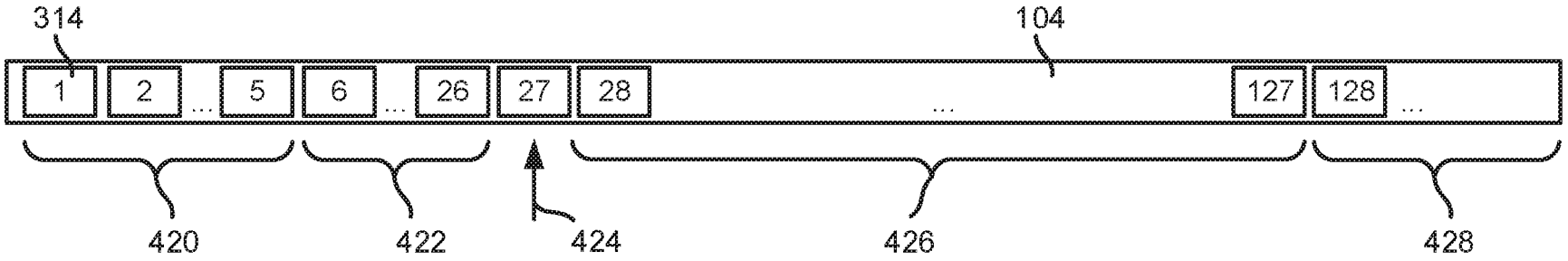
FIG. 4 is a block diagram illustrating multiple cycles of gap equalization for non-sequential printing with multiple print engines, according to an example of the principles described herein.

In one example, the system (FIG. 1, 100) may perform both types of adjustments. For example, for a first number of cycles such as five, a single iteration may correct for an entire calculated difference. In subsequent cycles, i.e., cycle six and thereafter, a multi-iterative schema could be implemented. FIG. 4 depicts a specific example of a timeline that implements both schemas.

Figure 3A:
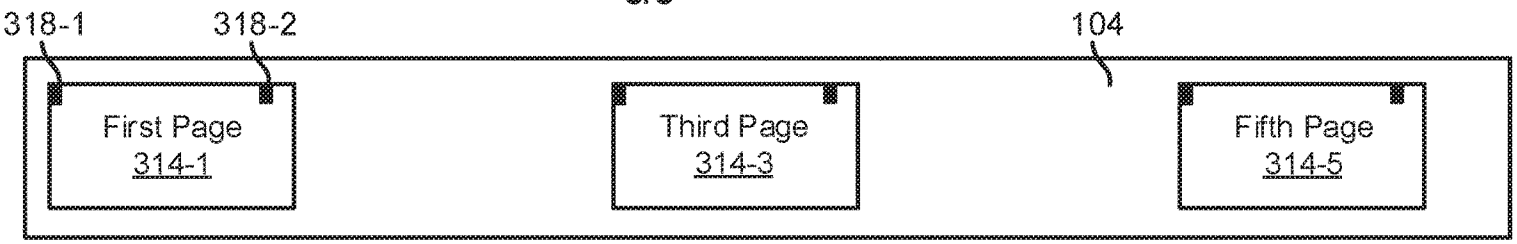
FIGS. 3A-3C are block diagrams depicting gap equalization for non-sequential printing with multiple print engines, according to an example of the principles described herein.
Figure 3B:
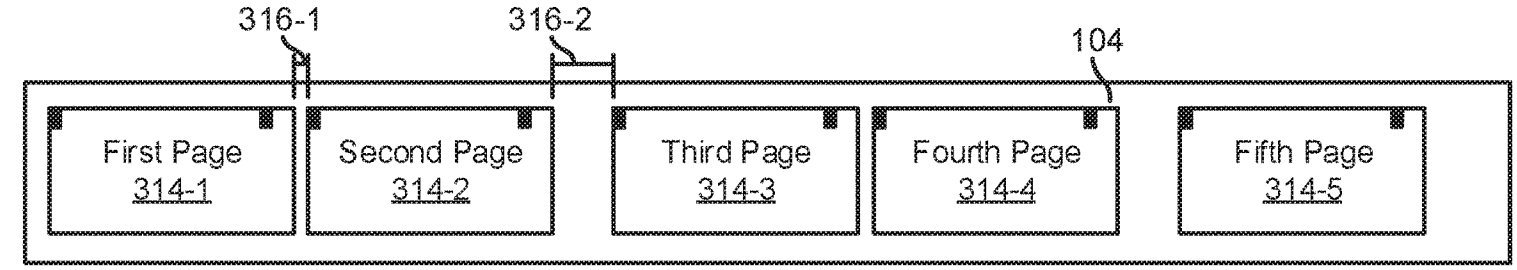
Figure 3C:
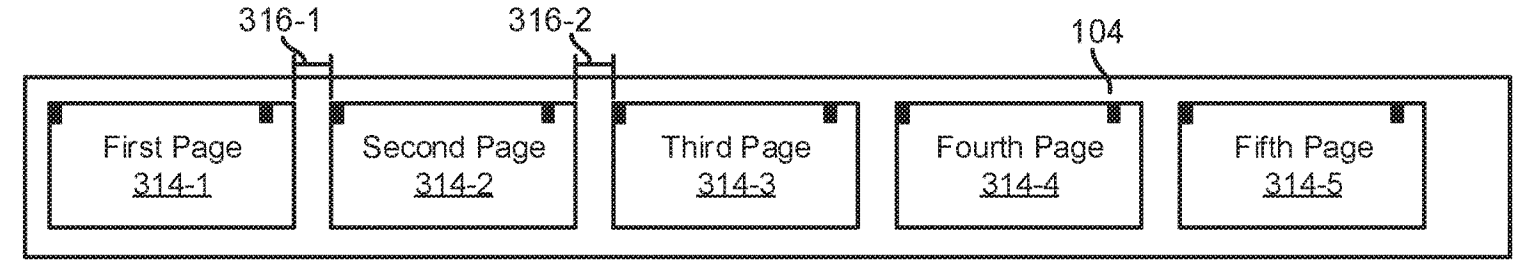

FIGS. 3A-3C are block diagrams depicting gap (316) equalization for non-sequential printing with multiple print engines (FIG. 1, 102), according to an example of the principles described herein. As described above, different print engines (FIG. 1, 102) may print non-sequential pages. For example, FIG. 3A depicts a substrate (104) exiting a first print engine (FIG. 1, 102-1). That is, the first print engine (FIG. 1, 102-1) has printed a first page (314-1), a third page (314-3), and a fifth page (314-5) and so on.

In addition to printing an image on the page, the first print engine (FIG. 1, 102-1) has printed registration marks (318) on the pages. Specifically, the first print engine (FIG. 1, 102-1) prints a leading edge registration mark (318-1) on a leading edge of the page (314) along a substrate travel direction indicated by the arrow, and a trailing edge registration mark (318-2) on a trailing edge of the page (314) along a substrate travel direction. For simplicity, a single instance of each of a leading edge registration mark (318-1) and a trailing edge registration mark (318-2) are indicated with a reference number.

FIG. 3B depicts the substrate (104) after having been processed by the second print engine (FIG. 1, 102-2). In this example, the second print engine (FIG. 1, 102-2) deposits the second page (314-2) in a blank space between the first page (314-1) and the fourth page (314-4) and the fourth page (314-4) in a blank space between the third page (314-3) and the fifth page (314-5).

However, for any number of reasons, the second page (314-2) and fourth page (314-4) are not centrally aligned between the adjacent pages (314-1, 314-3, 314-5). That is, a leading edge gap (316-1) of the second page (314-2) is smaller than a trailing edge gap (316-2). As described above, changing any number of print operations such first print engine (FIG. 1, 102-1) speed, second print engine (FIG. 1, 102-2) speed, first print engine (FIG. 1, 102-1) print timing, second print engine (FIG. 1, 102-2) print timing, and media transport speed among others can change the relative positions of the two such that the pages printed by the second print engine (FIG. 1, 102-2), i.e., the second page (FIG. 3, 314-2) and the fourth page (FIG. 3, 314-4) are centrally aligned between the other pages (314-1, 314-3, 314-5) as depicted in FIG. 3C. Note also in FIG. 3C that following operation of the sensor (FIG. 1, 110) and controller (FIG. 1, 112), the leading edge gap (316-1) and the trailing edge gap (316-2) of the corrected system are the same.

FIG. 4 is a block diagram illustrating multiple cycles of gap (FIG. 3, 316) equalization for non-sequential printing with multiple print engines (FIG. 1, 102), according to an example of the principles described herein. Specifically, FIG. 4 depicts a substrate (104) with pages (314) having been printed thereon by both the first print engine (FIG. 102-1) and the second print engine (FIG. 1, 102-2). For simplicity, just one instance of a page (314) has been indicated with a reference number, and the remaining pages have been indicated by a corresponding page number.

In this example, the sensor (FIG. 1, 110) and controller (FIG. 1, 112) may go through various stages of operation that may be defined in part, by the number of sequential pages (314) that have been processed. For example, in a first stage (420), a certain number of pages may pass without the sensor (FIG. 1, 110) taking any measurements. This may be due to the fact that the engines may be calibrating, or may not yet be calibrated, such that any sensor (FIG. 1, 110) information is unreliable. While FIG. 4 depicts this stage (420) as including five pages, this stage (420) and other stages may include different amounts of printed pages.

During a second stage (422), the sensor (FIG. 1, 110) may collect information regarding gap (FIG. 3, 316) distances and the controller (FIG. 1, 112) may work to calculate a difference between average values of the leading edge gap (FIG. 3, 316-1) size and the trailing edge gap (FIG. 3, 316-2) size. In this stage (422), no adjustments are made to the print engines (FIG. 1, 102) to alter page insertion points. That is, during a data collection period gap (FIG. 3, 316) differentials are calculated for a number of pages. While FIG. 4 depicts 20 pages per data collection period, any number of pages may be processed during this period, for example between 15 and 25.

During a third stage (424), printing operations are adjusted based on the output of the controller (FIG. 1, 102). That is operations of the first print engine (FIG. 1, 102-1), the second print engine (FIG. 1, 102-2) or any other component of the larger print system, are adjusted such that the gaps (FIG. 3, 316) are equal as depicted in FIG. 3C.

In a fourth stage (426), this cycle of measuring gap (FIG. 3, 316) sizes and making responsive adjustments continues and a full value of any determined difference is accounted for in a single adjustment operation. That is, the initial adjustment at the third stage (424) may result in overshoot and the operations adjusted too much. Accordingly, subsequent measurement and adjustment operations provide an opportunity to approach a centrally aligned page from a second printing engine (FIG. 1, 102-2). Moreover, over time, the operation of the printing device, printing engines (FIG. 1, 102) or properties of the substrate (104) may cause the pages to fall out of alignment. The subsequent measurement and adjustment operations may account for misalignment resulting after the initial detection phase (422) and adjustment phase (424).

As mentioned above, during this fourth stage (426), the entire difference between trailing edges and leading edges is corrected for in a single event. The fourth stage (426) is depicted as including five 20-page measurement cycles, but may include any number of measurement cycles of any size measurement cycle.

In a fifth stage (428), this cycle of measuring gap (FIG. 3, 316) sizes and making responsive adjustments continues, however instead of correcting for the full difference, each measurement cycle corrects for a portion of the difference. For example, during a first 20-page cycle of the fifth stage (428), a difference of 100 microns is detected between the trailing edge gap and the subsequent leading edge gap. Rather than correct or the entire 100 microns, the adjustment may correct for 20 microns of that space in a first subsequent cycle. Then during subsequent 20-page measurement cycles, the process is repeated. That is, in the fifth stage (428), the amount to which each gap (FIG. 3, 316) can be adjusted is limited to a certain threshold. Doing so prevents adjustment overshoot such that convergence to centralized page positioning is completed in a shorter amount of time.

Figure 5:
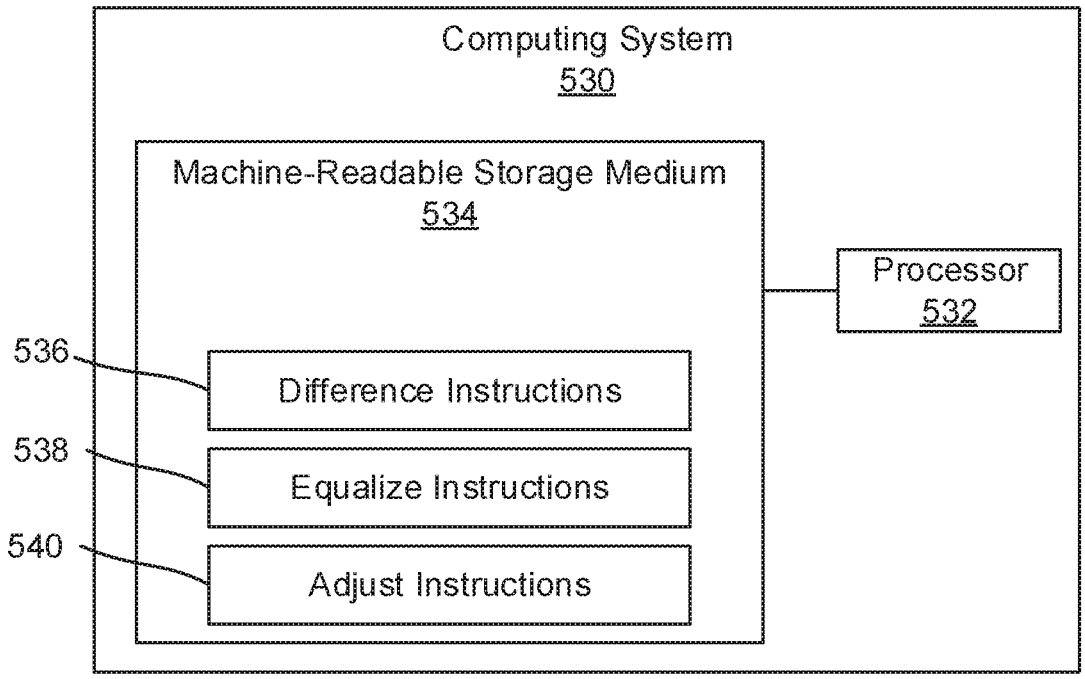
FIG. 5 is a diagram of a computing system for gap equalization for non-sequential printing with multiple print engines, according to an example of the principles described herein.

FIG. 5 is a diagram of a computing system (530) for gap (FIG. 3, 316) equalization for non-sequential printing with multiple print engines (FIG. 1, 102), according to an example of the principles described herein. To achieve its desired functionality, the computing system (530) includes various hardware components. Specifically, the computing system (530) includes a processor (532) and a machine-readable storage medium (534). The machine-readable storage medium (534) is communicatively coupled to the processor (532). The machine-readable storage medium (534) includes a number of instruction sets (536, 538, 540) for performing a designated function. The machine-readable storage medium (534) causes the processor (532) to execute the designated function of the instruction sets (536, 538, 540).

Although the following descriptions refer to a single processor (532) and a single machine-readable storage medium (534), the descriptions may also apply to a computing system (530) with multiple processors and multiple machine-readable storage mediums. In such examples, the instruction sets (536, 538, 540) may be distributed (e.g., stored) across multiple machine-readable storage mediums and the instructions may be distributed (e.g., executed by) across multiple processors.

The processor (532) may include at least one processor and other resources used to process programmed instructions. For example, the processor (532) may be a number of central processing units (CPUs), microprocessors, and/or other hardware devices suitable for retrieval and execution of instructions stored in machine-readable storage medium (534). In the computing system (530) depicted in FIG. 5, the processor (532) may fetch, decode, and execute instructions (536, 538, 540) for equalizing gap distances in multi-print engine (FIG. 1, 102) non-sequential printing. In one example, the processor (532) may include a number of electronic circuits comprising a number of electronic components for performing the functionality of a number of the instructions in the machine-readable storage medium (534). With respect to the executable instruction, representations (e.g., boxes) described and shown herein, it should be understood that part or all of the executable instructions and/or electronic circuits included within one box may, in alternate examples, be included in a different box shown in the figures or in a different box not shown.

The machine-readable storage medium (534) represent generally any memory capable of storing data such as programmed instructions or data structures used by the computing system (530). The machine-readable storage medium (534) includes a machine-readable storage medium that contains machine-readable program code to cause tasks to be executed by the processor (532). The machine-readable storage medium (534) may be tangible and/or non-transitory storage medium. The machine-readable storage medium (534) may be any appropriate storage medium that is not a transmission storage medium. For example, the machine-readable storage medium (534) may be any electronic, magnetic, optical, or other physical storage device that stores executable instructions. Thus, machine-readable storage medium (534) may be, for example, Random Access Memory (RAM), a storage drive, an optical disc, and the like. The machine-readable storage medium (534) may be disposed within the computing system (530), as shown in FIG. 5. In this situation, the executable instructions may be "installed" on the computing system (530). In one example, the machine-readable storage medium (534) may be a portable, external or remote storage medium, for example, that allows the computing system (530) to download the instructions from the portable/external/remote storage medium. In this situation, the executable instructions may be part of an "installation package". As described herein, the machine-readable storage medium (534) may be encoded with executable instructions for equalizing gap distances in multi-print engine (FIG. 1, 102) non-sequential printing.

Referring to FIG. 5, difference instructions (536), when executed by a processor (532), may cause the computing system (530) to determine for a number of pages (FIG. 3, 314) a difference between aa leading edge gap (FIG. 3, 316-1) and a trailing edge gap (FIG. 3, 316-2) between the page and corresponding adjacent pages. The adjacent pages, i.e., sequential pages, are printed by different print engines (FIG. 1, 102). Equalize instructions (538), when executed by a processor (532), may cause the computing system (530) to determine from the differences for the number of pages (FIG. 3, 314) an equalized value for subsequent leading edge gaps (FIG. 3, 316-1) and subsequent trailing edge gaps (FIG. 3-316-2). Adjust instructions (540), when executed by a processor (532), may cause the computing system (530) to adjust an operation of a printing device such that the subsequent leading edge gaps (FIG. 3, 316-1) and subsequent trailing edge gaps (FIG. 316-2) match the equalized value.

In some examples, the processor (532) and machine-readable storage medium (534) are located within the same physical component, such as a server, or a network component. The machine-readable storage medium (534) may be part of the physical component's main memory, caches, registers, non-volatile memory, or elsewhere in the physical component's memory hierarchy. In one example, the machine-readable storage medium (534) may be in communication with the processor (532) over a network. Thus, the computing system (530) may be implemented on a user device, on a server, on a collection of servers, or combinations thereof.

The computing system (530) of FIG. 5 may be part of a general-purpose computer. However, in some examples, the computing system (530) is part of an application specific integrated circuit.

In summary, using such a printing system and method 1) enhances second engine image placement; 2) reduces differences between trailing edge gaps and leading edge gaps for a page of a print job; 3) dynamically changes the adjustments over the duration of the print job; 4) provides a closed feedback loop to adjust gap sizes; and 5) enhances overall print quality. However, it is contemplated that the devices disclosed herein may address other matters and deficiencies in a number of technical areas. Therefore, the systems and devices disclosed herein should not be construed as addressing just the particular elements or deficiencies discussed herein.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printing system, comprising:

a print engine to receive non-sequentially printed pages having a blank space between each printed page, the print engine to print pages in the blank spaces;

a sensor to detect trailing edge registration marks and leading edge registration marks; and a controller to:

determine trailing edge gap sizes and leading edge gap sizes for pages printed by the print engine; and based on a difference between trailing edge gap sizes and leading edge gap sizes, adjust a printing operation of the print engine.

2. The printing system of claim 1, wherein the controller is to determine the difference between trailing edge gap sizes and leading edge gap sizes for each page printed by the print engine.

3. The printing system of claim 1, wherein the controller is to:

determine an average leading edge gap size for a set of pages printed by the print engine;

determine an average trailing edge gap size for a set of pages printed by the print engine; and determine the difference between the average leading gap size and the average trailing edge gap size.

4. The printing system of claim 1, wherein the sensor is to collect information regarding gap sizes during a stage before any adjustments are made.

5. The printing system of claim 1, wherein the controller adjusts a printing operation of the print engine to account for an entirety of the difference between trailing edge gap sizes and leading edge gap sizes.

6. The printing system of claim 1, wherein the controller adjusts a printing operation of the print engine to account for a portion of the difference between trailing edge gap sizes and leading edge gap sizes.

7. The printing system of claim 1, wherein the controller adjusts a printing operation of the print engine in multiple stages, a first stage to account for an entirety of the difference between trailing edge gap sizes and leading edge gap sizes and a second stage to account for a portion of any subsequently detected difference between trailing edge gap sizes and leading edge gap sizes.

8. The printing system of claim 1, wherein the system comprises an additional print engine.

9. The printing system of claim 8, wherein the print engine and the additional print engine print registration marks on leading edges and trailing edges of respectively printed pages, which respectively printed pages are non-sequential.

10. The printing system of claim 1, wherein the sensor is an optical scanner.

11. The printing system of claim 1, wherein the print engine is an electro photographic print engine.

12. The printing system of claim 1, wherein the print engine is an inkjet print engine.

13. The printing system of claim 1, the controller further to:

adjust operation of the print engine such that subsequent trailing edge gaps and subsequent leading edge gaps are a same size.

14. The printing system of claim 13, the controller further to adjust at least one of:

a speed of a substrate transport system;

a speed of the print engine; and a timing of printing compound application.

15. The printing system of claim 1, the controller further to determine trailing edge gap sizes and leading edge gap sizes and adjust the printing operation of the print engine while the print engine is printing pages.

16. The printing system of claim 1, wherein the controller comprise:

a processor;

a machine-readable storage medium coupled to the processor; and an instruction set, the instruction set being stored in the machine-readable storage medium to be executed by the processor, wherein the instruction set comprises:

instructions to print, by a print engine, pages on blank spaces between received non-sequential printed pages;

instructions to determine, for each page printed by the print engine, differences between trailing edge gap sizes and leading edge gap sizes;

instructions to determine from the differences between trailing edge gap sizes and leading edge gap sizes, an equalized value for subsequent trailing edge gaps and for subsequent leading edge gaps; and instructions to adjust an operation of the print engine such that subsequent trailing edge gaps and subsequent leading edge gaps match the equalized value.

17. The printing system of claim 16, further comprising a database that comprises a mapping between differences in gap sizes and an adjustment to the print operation.

18. The printing system of claim 17, wherein the database comprises a mapping between differences in gap sizes and multiple print operations.

19. The printing system of claim 16, further comprising instructions specifying that, during an adjustment stage, no measurements of leading edge gap sizes and trailing edge gap sizes are made.

* * * * *